United States Patent [19]

Hannigan

[11] 4,398,923

[45] Aug. 16, 1983

[54] VESSEL ACCESS PORT

[75] Inventor: Norman J. Hannigan, Katy, Tex.

[73] Assignee: BS&B Engineering Company, Inc., Houston, Tex.

[21] Appl. No.: 369,573

[22] Filed: Apr. 19, 1982

[51] Int. Cl.[3] ..... C10J 3/72

[52] U.S. Cl. ..... 48/87; 110/173 R; 202/246; 202/269

[58] Field of Search ..... 48/87; 202/246, 269; 266/271, 272; 110/173

[56] References Cited

U.S. PATENT DOCUMENTS 1,999,782 4/1935 Rehm ..... 48/87 X
2,585,417 2/1952 Williams ..... 48/87
4,211,536 7/1980 Hamilton ..... 48/87
4,230,532 10/1980 Harris ..... 202/246 X

*Primary Examiner*—Arthur D. Kellogg
*Attorney, Agent, or Firm*—Bard, Groves, Sroufe & Bishop

[57] ABSTRACT

An improved access port structure for a vessel, such as a coal gassification furnace, in which a closure member is mounted for movement, on the vessel to open or close an opening, a means of providing a steam vortex flowing into the opening to prevent the escape of gases from the vessel, and an interconnection to the steam supply to assure that the vortex is operating prior to the opening of the closure member.

9 Claims, 5 Drawing Figures

VESSEL ACCESS PORT

BACKGROUND OF THE INVENTION

The present invention relates to a safety access port structure for a furnace or other fired vessel, such as a coal gassifier. Access ports on coal gassifiers have been used for viewing the interior of the vessel and for poking or stirring the bed of coal and clinkers in the vessel. Particular difficulty and danger ar encountered by operators if the access port is not protected or shielded when it is opened. Ports of the prior art have included jets of steam or other fluid injected tangentially of the port to create a vortex which prevents the fluids within the vessel from flowing through the open port.

One problem which has been encountered with prior access ports on coal gassifiers is than even though a steam vortex creating jet is provided it is possible to open the access port without having the steam jet in operation.

SUMMARY

The present invention relates to an improved access port structure for a coal gassifier or other fired vessel including a closure member pivotally mounted to move into sealing engagement across the port or opening in the vessel, a latch for retaining the closure member in sealing engagement across the port, a valve controlling flow of steam to create an inwardly flowing vortex in the port, a locking shaft on which the closure member is mounted and a lever connected to the valve to open and close the valve and also connected to slide the locking shaft between locked and unlocked positions, the locking shaft reaching its unlocked position only after the steam valve is open and retaining the steam valve open until the closure member is reseated.

An object of the present invention is to provide an improved access port structure for a vessel containing hot gases which assures that no gases can escape from the vessel when the port is opened.

Another object is to provide an improved access port structure which cannot be inadvertently opened.

A further object is to provide an improved vessel access port structure which protects the operator using the port.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

Figure 1:
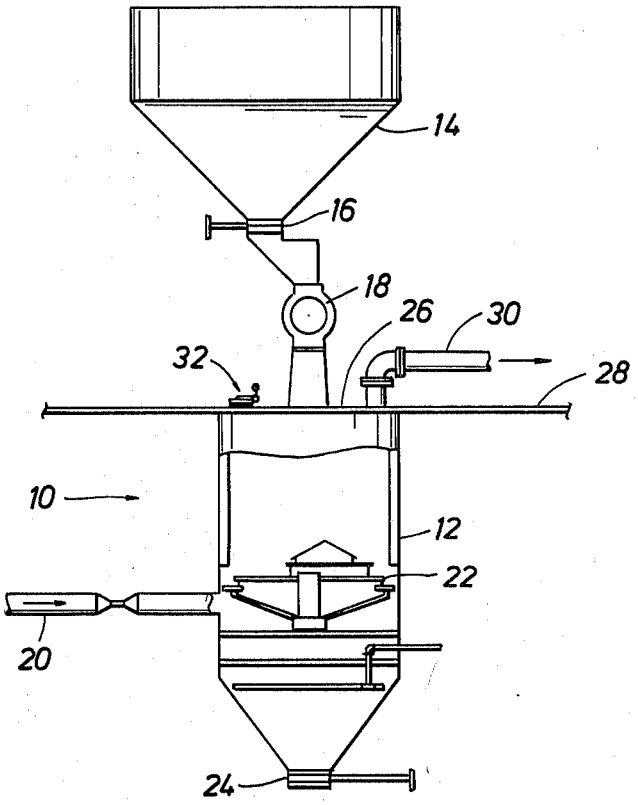
FIG. 1 is an elevation view of a coal gassifier on which the improved access port structure of the present invention has been installed and with portions of the vessel broken away to show the interior.
Figure 3:
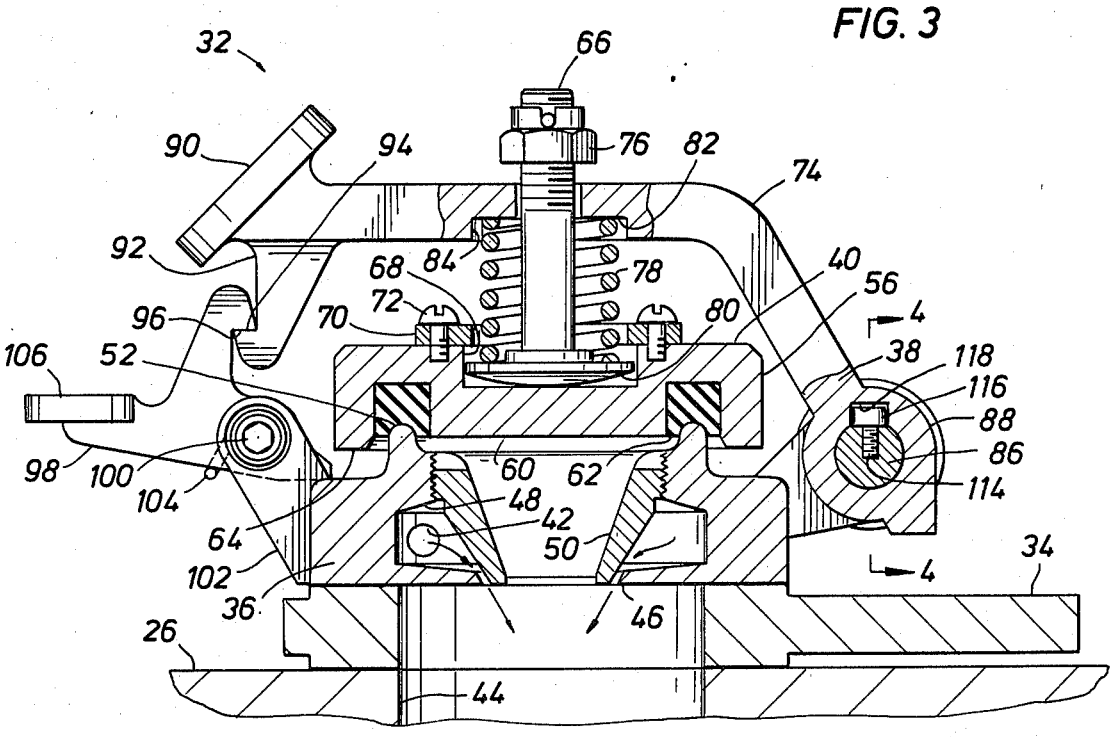
FIG. 3 is a sectional view of the improved structure showing the closed and latched position of the operating arm taken along line 3—3 in FIG. 2.

The device shown in FIG. 1 is a coal gassifier having a vessel 12 with coal being supplied to vessel 12 from bunker 14 through valve 16 and rotary feed drum 18. An air blast is delivered through lines 20 into vessel 12 below grate 22. Ash is discharged from the lower end of vessel 12 under control of discharge valve 24. Top 26 of vessel 12 is at the same level as floor 28. Gas produced in vessel 12 is discharged through outlet 30. Access port structure 32 is positioned in top 26 of vessel 12 as shown so that it will be readily accessible from floor 28.

Access port structure 32 includes base plate 34 and mounting base ring 36 which are secured to vessel top 26 by bolts 38, closure member 40 which is pivotally mounted to base ring 36 by suitable pivoting means, as hereinafter described, and means to assure the start of flow of steam through port 42 in base ring 36 to generate a vortex flowing into the opening 44 in vessel top 26 to ensure that when closure member 40 unseats there will not by any escape of gases from the interior of vessel 12 through opening 44. Base ring 36 has a central opening 46 which is smaller than opening 44 and such opening is defined by inwardly projecting tapered lip 46. The upper portion of base ring 36 includes inwardly extending flange 48 which is internally threaded to receive conical deflector 50. Flange 48 also includes upstanding annular seat 52. Thus, steam is directed from port 42 tangentially within conical deflector 50 and escapes into vessel 12 through the narrow opening between the interior of lip 46 and the lower exterior of deflector 50. This is a high velocity flow which creates a vortex flowing into vessel 12 through opening 44. The amount of steam flow is adjusted to assure that the vortex has sufficient strength so that none of the gases in vessel 12 can escape through opening 44 when vortex is operating. Shaft supports 54 are integral with base ring 36 as shown.

Closure member 40 includes circular plate 56 having an annular recess 60 in its lower side in which sealing ring 62 is positioned and outer depending lip 64 which extends downwardly below the lower portion of sealing ring 62 as shown. The upper surface of plate 56 has bolt 66 secured in recess 68 by ring 70 which is secured to plate 56 by screws 72. Bolt 66 extends above plate 56 and through arm 74 and nut 76 is threaded and locked onto the end of bolt 66 above arm 74. Spring 78 surrounds bolt 66 and engages the shoulder of bolt head 80 and the surface 82 in recess 84 in arm 74.

Arm 74 is mounted on lock shaft 86 which is supported in supports 54 for axial movement as hereinafter described. One end of arm 74 includes sleeve 88 surrounding lock shaft 86 and the other end includes foot pad 90 and latch lug 92 having shoulder 94 facing upward for engagement with shoulder 96 on latch lever 88. Latch lever 98 is mounted on shaft 100 which extends through ears 102 projecting from base ring 36. Spring 104 surrounds shaft and engages one of ears 102 and latch lever 98 to bias lever 98 to its upper position. Latch lever 98 also includes foot pad 106 for pivoting latch lever 98 away from latching engagement with latch lug 92 on arm 74.

Figure 2:
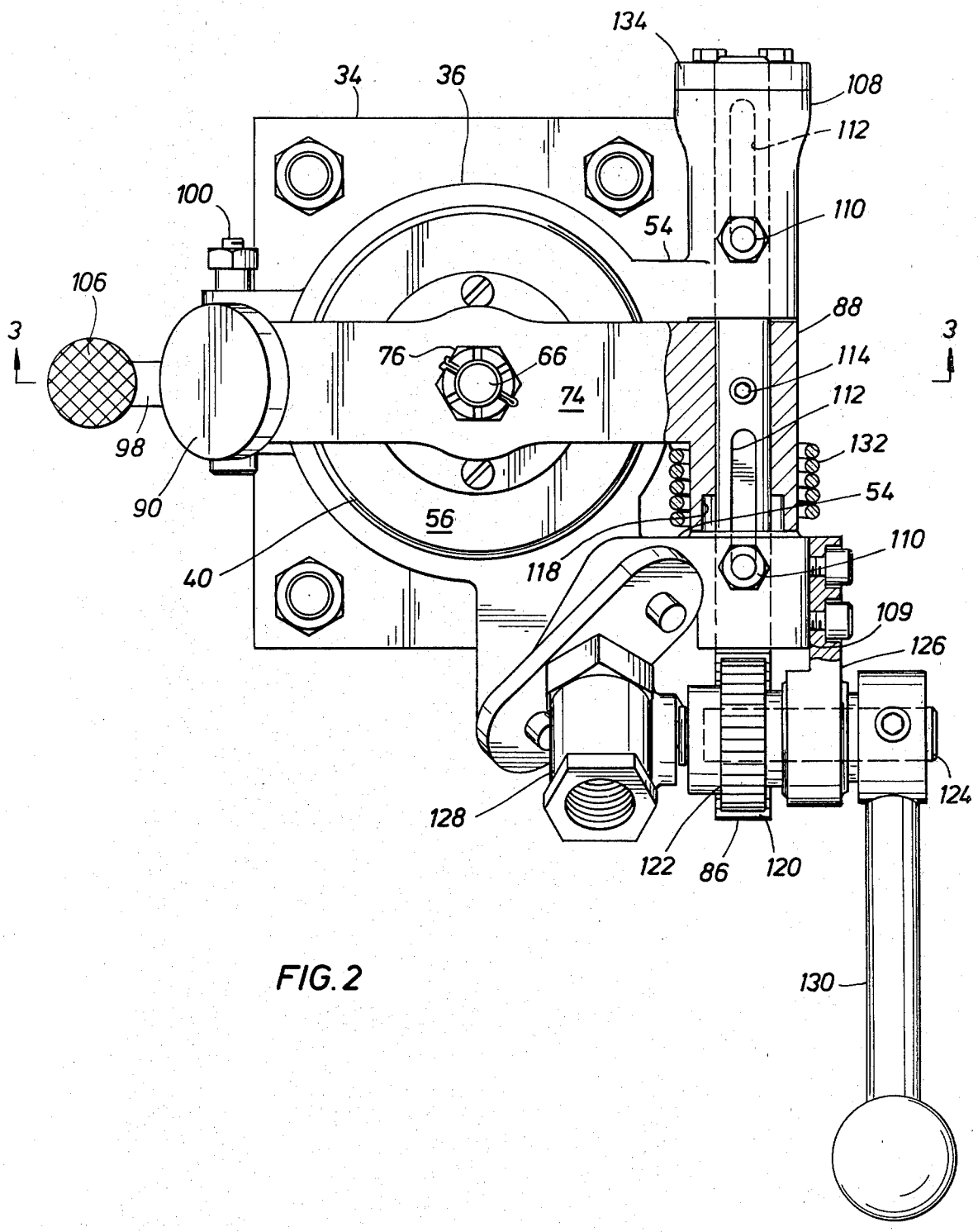
FIG. 2 is a plan view of the improved structure of the present invention.

Sleeves 108 and 109 on the ends of shaft supports 54 receive shaft 86 and have cap screws 110 extending therethrough into engagement within slots 112 in shaft 86 as shown in FIG. 2. Cap screw 114 is secured in shaft 86 and has its head 116 protruding into L-slot 118 on the interior of sleeve 88.

Shaft 86 extends beyond sleeve 109 and has rack 120 on its upper surface. Pinion 122 coacts with rack 120 to cause shaft 86 to move axially in sleeves 108 and 109.

Pinion 122 is secured on shaft 124 which is journaled in plate 126 and engages the operator of steam valve 128. Plate 126 is secured to sleeve 109 and steam valve 128 is secured to base ring 36 to control the flow of steam into steam port 42. Arm 130 is suitably secured to the end of shaft 124 to rotate pinion 124 to move shaft 86 axially and to open and close steam valve 128.

Spring 132 surrounds shaft 86 between sleeve 88 and sleeve 109 and urges arm 74 in the direction to cause closure member 40 to move away from seat 52. Plate 134 is secured to the end of sleeve 108.

Figure 4:
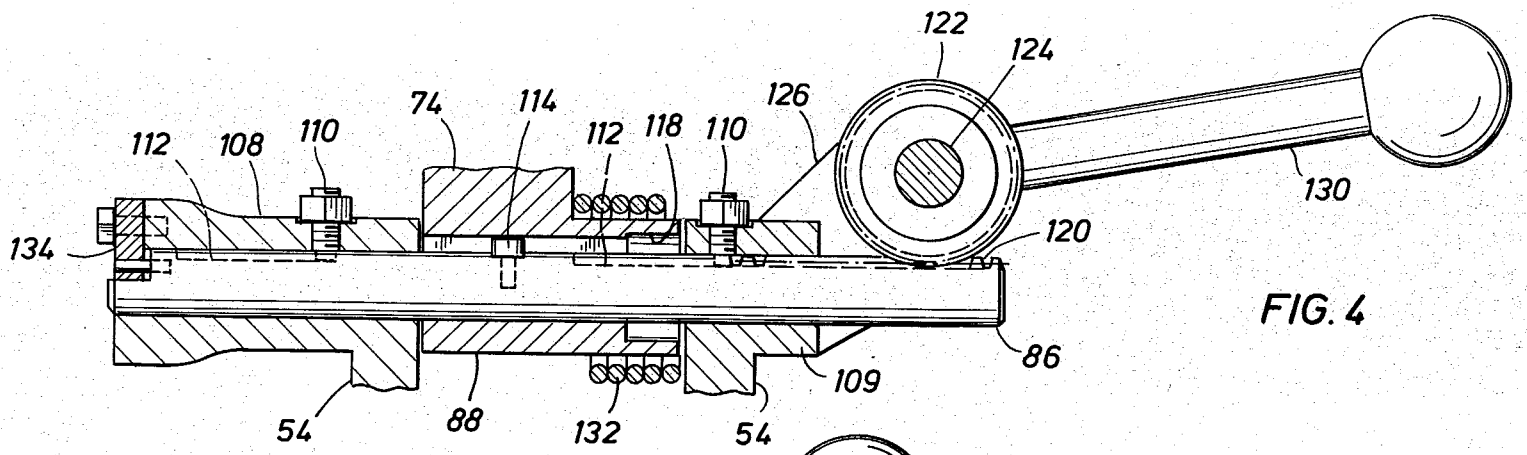
FIG. 4 is a sectional view taken along line 4—4 in FIG. 2 illustrating the locking shaft in locked position.
Figure 5:
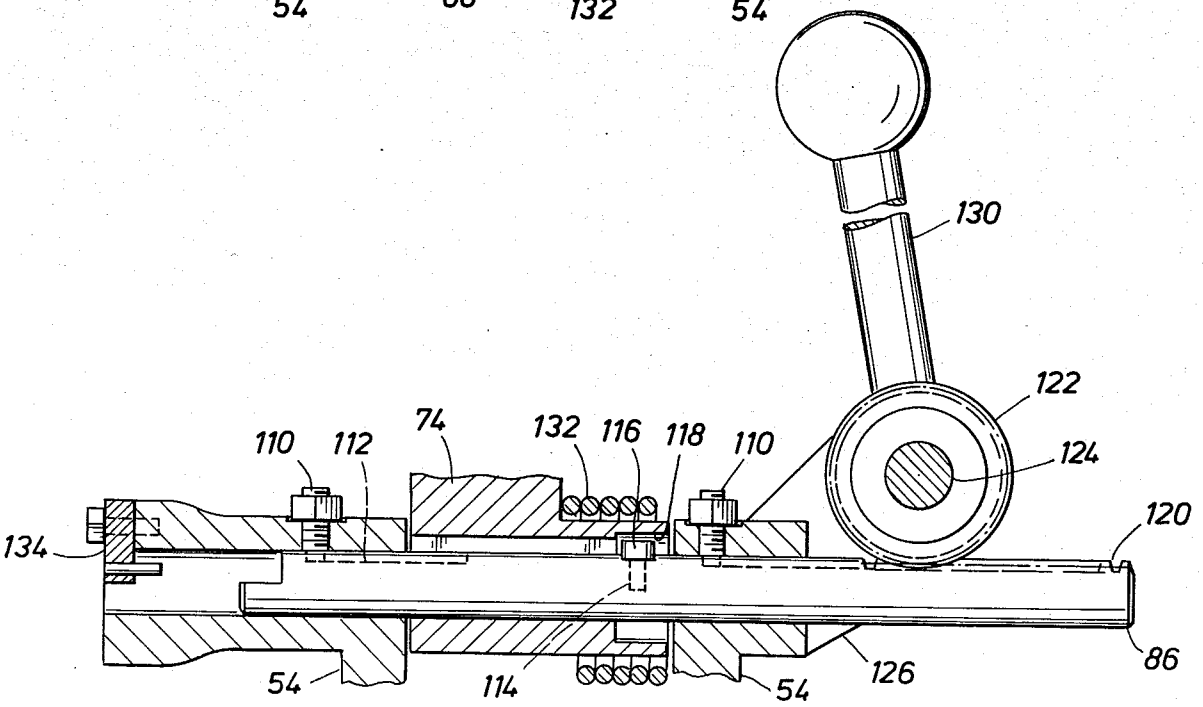
FIG. 5 is a similar sectional view illustrating the locking shaft in unlocked position.

When vessel 10 is in operation producing coal gas, access may be allowed through the improved access port structure of the present invention. With closure member 40 in engagement with seat 54 and latch lever 98 engaging shoulder 94 on arm 74 to retain closure member on seat 52, arm 130 is moved to open steam valve 128 and to move shaft 86 axially from the position shown in FIG. 4 to the position shown in FIG. 5. In this second position, head 116 of screw 114 has moved from the axial portion into the circumferential portion of L-slot 118. Stepping on pad 106 releases the latching of closure member 40 and spring 132 pivots it to its open position.

When the use of the opening into vessel is completed, stepping on pad 90 brings closure member 40 onto seat 52 and the lower portion of latch lug 92 cams latch lever 98 outward and further movement allows latch lever 98 to move its shoulder 96 into latching engagement with shoulder 94 on latch lug 92 to latch closure member 40 in seated position on seat 52. Valve 128 can then be shut off by movement of arm 130 from the position of FIG. 5 to the position of FIG. 4 and also shaft 86 is shifted to position screw head 116 in the axial portion of L-slot 118 to lock closure member 40 in seated position. Spring 78 also forces closure member 40 toward seated position with sufficient force to maintain a seal on seat 52 even if latch lever 98 is released from latch lug 92.

With this improved access port structure gases from the interior may not escape since it cannot be opened unless steam valve is open.

What is claimed is:

1. An access port structure for a vessel having an opening therethrough comprising, means secured to said vessel surrounding the vessel opening and defining a seat, a closure plate, means supporting said closure plate for movemement into engagement with said seat and away from said seat, means for creating a vortex extending into said vessel through said opening, means supplying steam to said vortex creating means, valve means in said supply means, and means interconnecting said closure plate and said valve means assuring opening of valve means prior to opening said closure plate.

2. An access port structure according to claim 1 wherein said closure plate supporting includes an axially movable shaft on which said closure plate is pivotally mounted, and said interconnecting means includes means preventing pivoting of said closure plate about said shaft except when said shaft is shifted axially to the end of its movement in one direction, and means for shifting said shaft axially and for opening said valve means during initial shifting of said shaft in said one direction.

3. An access port structure for a vessel opening comprising, a ring secured around the vessel opening and having a conical deflector therein with an opening between the ring and the deflector, and a seat surrounding the opening through the ring, a shaft supported for axial movement, a closure member, an arm supporting the closure member and pivotally mounted on said shaft so that the closure member moves to and from engagement with said seat, a steam valve supported from said ring and controlling flow of steam through said opening to create an inwardly flowing vortex, means on said shaft preventing pivoting of said arm to move the closure member off said seat except when said shaft is in one of its extreme axial positions, and means for opening said steam valve and for moving said shaft to the position allowing opening of said closure member whereby said closure member only moves off said seat after a steam vortex is created.

4. An access port structure according to claim 3 wherein said opening and moving means includes, a rack on said shaft, a pinion mounted on a second shaft in engagement with the rack, means on the pinion shaft for operatively engaging said steam valve whereby the steam valve is opened as said pinion starts to rotate.

5. An access port structure according to claim 4 wherein, said shaft includes a projection, and said arm includes an internal slot receiving said projection, one portion of said slot being axial and the other portion being circumferential, said arm pivoting only when said projection is in the circumferential porton of said slot.

6. An access port structure according to claim 4 including, latch means for releasably retaining said closure member in engagement with said seat.

7. An access port structure according to claim 4 including, spring means between said closure member and said arm to bias said closure member toward seated position.

8. A coal gassifier vessel comprising, a vessel having side walls, a bottom, a grate and a top, means for feeding coal to the vessel, means for discharging ashes from the vessel bottom, means for delivering an air blast into the vessel, means for discharging gas produced from the vessel, said vessel top having an opening therethrough, a seat, means for securing said seat to said top around said opening, a closure member, means for mounting said closure member into and from engagement closing said seat, means for creating a steam vortex flowing inward in said vessel opening, valve means controlling flow of steam to said vortex means, and means preventing opening movement of said closure member until said valve means is open to create said steam vortex.

9. A coal gassifier according to claim 8 wherein, said mounting means includes an axially movable shaft on which said closure member is pivotally mounted in one extreme axial position of said shaft, means for moving said shaft axially being interconnected to said steam valve to slide said shaft toward said extreme axial position during opening of said steam valve to provide said opening preventing means.

* * * * *

UNITED STATES PATENT AND TRADEMARK OFFICE

CERTIFICATE OF CORRECTION

PATENT NO. : 4,398,923

DATED : August 16, 1983

INVENTOR(S) : Norman J. Hannigan

It is certified that error appears in the above-identified patent and that said Letters Patent are hereby corrected as shown below:

Column 1, line 10, "ar" should be --are--;

Column 1, line 17, "than" should be --that--;

Claim 5, last line, "porton" should be --portion--.

Signed and Sealed this

*Fifteenth* Day of *November 1983*

[SEAL]

*Attest:*

GERALD J. MOSSINGHOFF

*Attesting Officer*

*Commissioner of Patents and Trademarks*